US007773047B2

(12) United States Patent
Horikoshi et al.

(10) Patent No.: US 7,773,047 B2
(45) Date of Patent: Aug. 10, 2010

(54) ANTENNA AND METHOD OF MAKING THE SAME

(75) Inventors: Toshiyuki Horikoshi, Hitachi (JP); Masahiko Kobayashi, Hitachi (JP); Seigi Aoyama, Kitaibaraki (JP); Hiroshi Yamanobe, Hitachi (JP); Shinsuke Murano, Kasama (JP)

(73) Assignee: Hitachi Cable, Ltd., Tokyo (JP)

( * ) Notice: Subject to any disclaimer, the term of this patent is extended or adjusted under 35 U.S.C. 154(b) by 726 days.

(21) Appl. No.: 11/523,734

(22) Filed: Sep. 20, 2006

(65) Prior Publication Data

US 2007/0069971 A1 Mar. 29, 2007

(30) Foreign Application Priority Data

Sep. 21, 2005 (JP) ..... 2005-274011

(51) Int. Cl.
*H01Q 1/40* (2006.01)

(52) U.S. Cl. ..... 343/873; 343/895

(58) Field of Classification Search ..... 343/873, 343/895, 897

See application file for complete search history.

(56) References Cited

U.S. PATENT DOCUMENTS

| | | | | |
|---|---|---|---|---|
| 4,999,639 | A | 3/1991 | Frazita et al. | |
| 6,034,650 | A | 3/2000 | Kuramoto | |
| 6,173,898 | B1 * | 1/2001 | Mande | 235/488 |
| 6,316,104 | B1 | 11/2001 | Kumakura | |
| 6,517,005 | B1 * | 2/2003 | Ayala | 235/492 |
| 6,917,345 | B2 * | 7/2005 | Hamada et al. | 343/895 |
| 6,924,777 | B2 * | 8/2005 | Reasoner et al. | 343/866 |
| 7,492,326 | B1 * | 2/2009 | Bodlovic et al. | 343/873 |

FOREIGN PATENT DOCUMENTS

| | | |
|---|---|---|
| CN | 1193826 A | 9/1998 |
| CN | 1272127 A | 11/2000 |
| JP | 2000-76398 | 3/2000 |
| JP | 2001-101371 | 4/2001 |
| JP | 2001-102745 | 4/2001 |

OTHER PUBLICATIONS

Chinese Office Action dated Mar. 1, 2010 (with English translation).

* cited by examiner

*Primary Examiner*—Tan Ho
(74) *Attorney, Agent, or Firm*—McGinn IP Law Group, PLLC

(57) ABSTRACT

An antenna having an antenna element bent in a predetermined shape. The antenna element has a plurality of line conductors that are arranged in parallel and are sandwiched by two insulation films. A method of making an antenna has the steps of: arranging in parallel a plurality of line conductors, each of which having a width of 0.04 mm or less, at intervals of 10 times or more the width of each of the line conductors; discharging continuously the plurality of line conductors such that visibility of the line conductors is reduced; and sandwiching continuously the discharged line conductors by planar transparent insulation films with a sticking or adhesion layer to have an antenna element.

17 Claims, 4 Drawing Sheets

ANTENNA AND METHOD OF MAKING THE SAME

The present application is based on Japanese patent application No. 2005-274011 filed on Sep. 21, 2005, the entire contents of which are incorporated herein by reference.

BACKGROUND OF THE INVENTION

1. Field of the Invention

This invention relates to an antenna for wireless radio communication which receives VHF band and UHF band and, more particularly, to an antenna with decreased visibility of itself and a method of making the antenna.

2. Description of the Related Art

Conventionally, in considering a half-wave dipole antenna as an antenna element to send and receive VHF band (30-300 MHz) and UHF band (300 MHz-3 GHz), a dipole antenna 3 comprises a pair of conductor plates 1, 1, and a feeding portion 2 connected with the conductor plates 1, 1 as shown in FIG. 8.

To decrease the visibility, a film antenna is known that the conductor plate 1 is composed of printing with conductive paste or wire material. Although length L may be varied, the most fundamental one is provided with a length of ½ of the wavelength, for instance, L=about 300 mm for 500 MHz because its wavelength is 600 mm. In this case, although the width W of the conductor is determined by a resistance value for impedance matching with the feeding portion, it needs generally to be several mm or more as a practical size even if the copper wire with a low resistivity is used. Therefore, the visibility cannot be decreased.

In case of using the conductive paste, the resistivity is about 20 times compared with copper even if the paste is of silver having the lowest resistivity. Thus, if the conductor width is not wider than that in case of using the copper wire, the resistance increases and the impedance matching with the feeding portion cannot be obtained.

Conventional antennas have been manufactured by the following methods.

(1) An antenna is formed by passing a conductive thin wire through a special tool (nozzle), moving on the orbit of the special tool while discharging the thin wire, and pasting the thin wire on an adhesive sheet (called drawing method, e.g., JP-A-2000-76398).

(2) An antenna is formed by preparing a substrate, screen-printing a conductive ink thereon by using a mesh plate, and drying and hardening the ink (called paint method, e.g., JP-A-2001-102745).

(3) A coil is formed by using a metallic foil as a conductor, masking a part to be left as an antenna, and removing other part than the part to be left by etching (called etching method, e.g., JP-A-2001-101371).

As a result, the conventional antenna element is not negligible in visual sense since the conductor plate 1 is as large as several mm in width W and about 300 mm in length L. When the antenna is installed at a place such as a window of a vehicle, inside of the vehicle or on the periphery of a television, the visibility in seeing the outside from the vehicle may be reduced, or the design harmony of the entire vehicle may deteriorate.

Further, there are following problems in view of the manufacturing method of the antenna.

In the above drawing method (1), since it is difficult to increase the density, the entire antenna area must be too large in case of using many turns. Further, when manufacturing an antenna in complex shape, it takes time since the drawing work is not easy, and the cost rises that much.

In the above paint method (2), the resistivity is generally about 20 times compared with the copper even if the paste is silver having the lowest resistivity. Thus, if the conductor width is not wider than that in case of using the copper wire, the resistance increases and the impedance matching with the feeding portion cannot be obtained. Further, the cost is increased due to using the expensive silver paste.

In the above etching method (3), there are many problems on the management of the agents or an environmental point of view since the etching agent is used. The productivity (material yield) is low since it is necessary to dissolve the other part than the antenna. Further, the production speed is reduced since it takes time to dissolve it.

SUMMARY OF THE INVENTION

It is an object of the invention to provide an antenna and a method for manufacturing the same to be formed in an arbitrary shape so as to reduce the visibility.

(1) According to one aspect of the invention, an antenna comprises;

an antenna element bent in a predetermined shape, wherein the antenna element comprises a plurality of line conductors that are arranged in parallel and are sandwiched by two insulation films.

In the above invention (1), the following modifications and changes can be made.

(i) The antenna element is sandwiched by two insulating substrates while exposing both ends of the antenna element from the two insulating substrates.

(ii) The antenna further comprises a metal plate that is attached onto the insulation films and at both ends of the antenna element.

(iii) The line conductors each comprise a silver coating copper alloy, and a diameter of 0.04 mm or less.

(iv) The insulating substrates and the insulation films comprise a material with a light transmitting property.

(v) An interval between the neighboring line conductors is 10 times or more a diameter of each of the line conductors.

(2) According to another aspect of the invention, a method of making an antenna comprises the steps of:

arranging in parallel a plurality of line conductors, each of which having a width of 0.04 mm or less, at intervals of 10 times or more the width of each of the line conductors;

discharging continuously the plurality of line conductors such that visibility of the line conductors is reduced; and sandwiching continuously the discharged line conductors by planar transparent insulation films with a sticking or adhesion layer to have an antenna element.

In the above invention (2), the following modifications and changes can be made.

(vi) The method further comprises the steps of:

cutting the antenna element into an arbitrary length; and forming the antenna by bending the cut antenna element once or more at an arbitrary angle so as to allow arbitrary adjustment of an emission characteristic of the antenna.

(vii) The method further comprises the step of:

fixing the antenna element on a planar transparent insulating substrate with a sticking or adhesion layer, or fixing the antenna element by sandwiching the antenna element between two planar transparent insulating substrates with a sticking or adhesion layer.

(viii) The method further comprises the step of:

attaching a metal line or a metal plate onto the insulation film at a feeding portion of the antenna element such that the metal line or the metal plate is electrostatically coupled to the line conductor through the insulation film to allow power feeding therebetween.

ADVANTAGES OF THE INVENTION

The invention has a beneficial effect that a free shape antenna can be produced by bending a long antenna element formed by sandwiching both sides of line conductors by insulation films without need to worry about short circuiting etc. of the line conductors even when it is bent in a desired shape.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Preferred embodiments according to this invention will be explained in more detailed in conjunction with the appended drawings.

Figure 1:
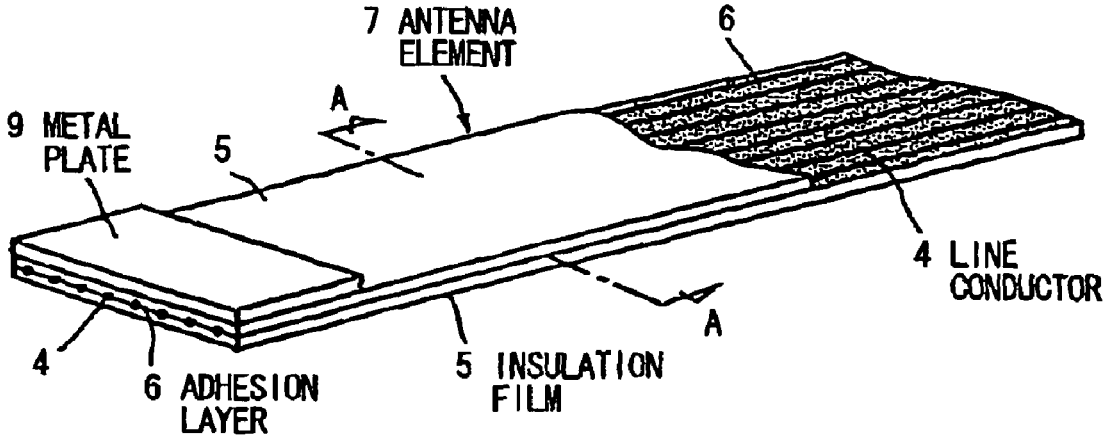
FIG. 1 is a perspective view showing an antenna element in a preferred embodiment according to this invention.
Figure 2:
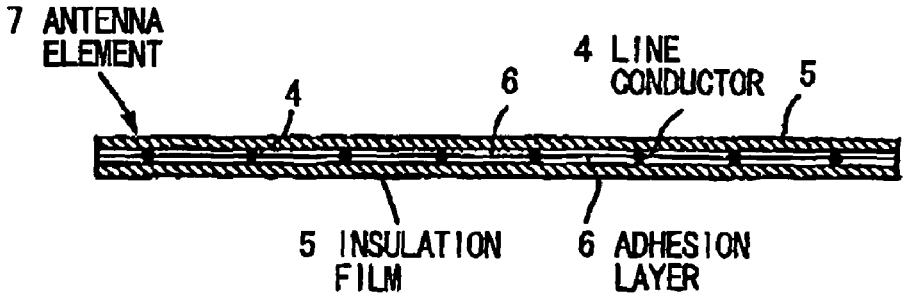
FIG. 2 is a cross sectional view cut along a line A-A in FIG. 1.

FIG. 1 is a perspective view showing a main part of an antenna element in a preferred embodiment of the invention, and FIG. 2 is a cross sectional view cut along the A-A line in FIG. 1.

First of all, the antenna element 7 is formed in a long tape shape by sandwiching a plurality of arranged line conductors 4 with transparent insulation films 5 each having an adhesion layer 6.

The line conductor 4 is constructed such that the width (or diameter) is to be 0.04 mm or less to decrease the visibility. The line conductors 4 are aligned at intervals of ten times or more the width (or diameter) of the line conductor 4, and the antenna element 7 is formed by sandwiching the line conductor 4 with the insulating films 5 with the adhesion layer 6. The antenna element 7 is bent arbitrarily according to the shape of a linear antenna, such as a dipole antenna and a loop antenna, to be formed so as to integrate the line part of the antenna element line part with the feeding line portion. The feeding is enabled by attaching a metal plate 9 on the insulation film 5 at the edge where to be the feeding line portion such that the metal plate 9 is electrostatically coupled to the line conductor 4 of the antenna element 7 through the insulation film 5.

An apparatus for manufacturing the long antenna element 7 and a method for manufacturing the same will be explained referring to FIGS. 3 and 4.

Figure 3:
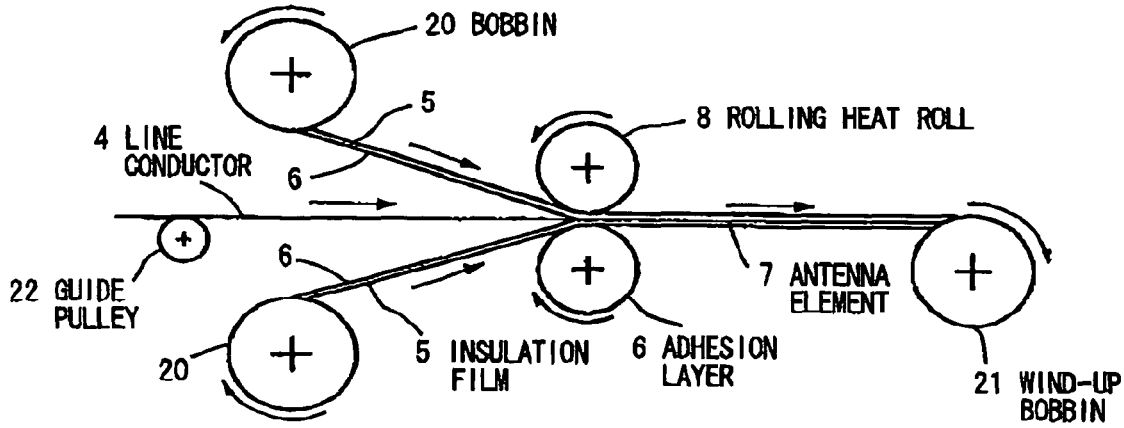
FIG. 3 is a front view showing an apparatus for manufacturing an antenna element of the invention.
Figure 4:
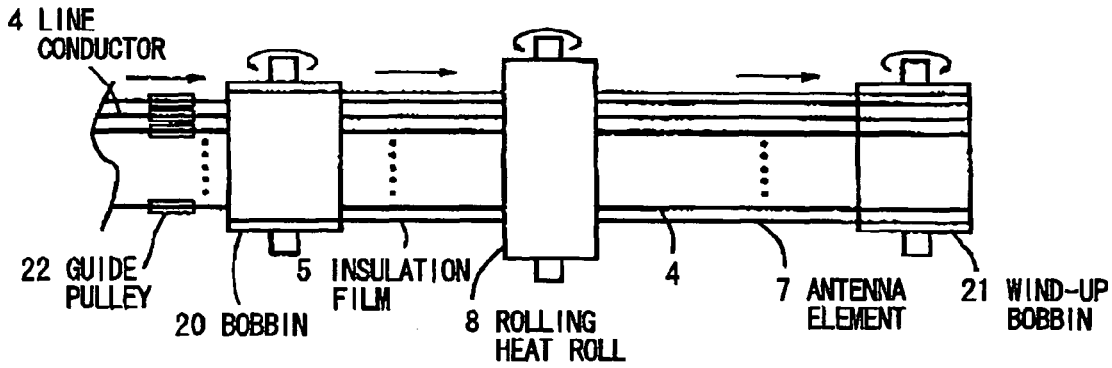
FIG. 4 is a plain view showing the apparatus in FIG. 3.

FIG. 3 is a front view showing the manufacturing apparatus and FIG. 4 is a plan view showing the apparatus in FIG. 3.

As shown in FIGS. 3 and 4, a plurality of the line conductors 4 are aligned and let out continuously by a guide pulley 22 and, at the same time, sandwiched by the planar insulation films 5 with an adhesive or the adhesion layer 6 having a light transmitting property (transparency) which is wound around a bobbin 20. The long antenna element 7 with the thin line conductor 4 wired on the sticking or adhesion layer 6 of the insulation films 5 is manufactured by sticking the insulation films 5 together with each other continuously by rolling heat rolls 8, 8 (at rolling temperature of 150° C.), and then wound around a wind-up bobbin 21.

Figure 5:
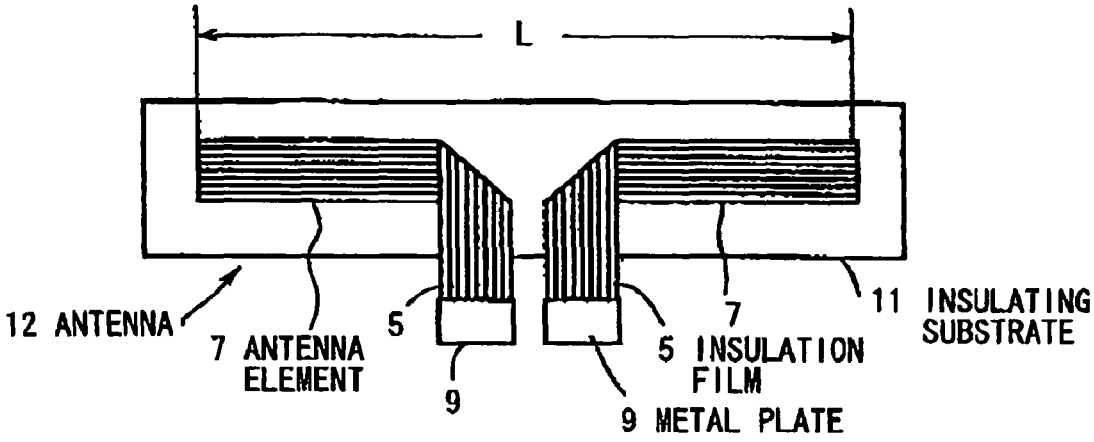
FIG. 5 is a schematic diagram showing a dipole antenna formed using an antenna element of the invention.
Figure 6:
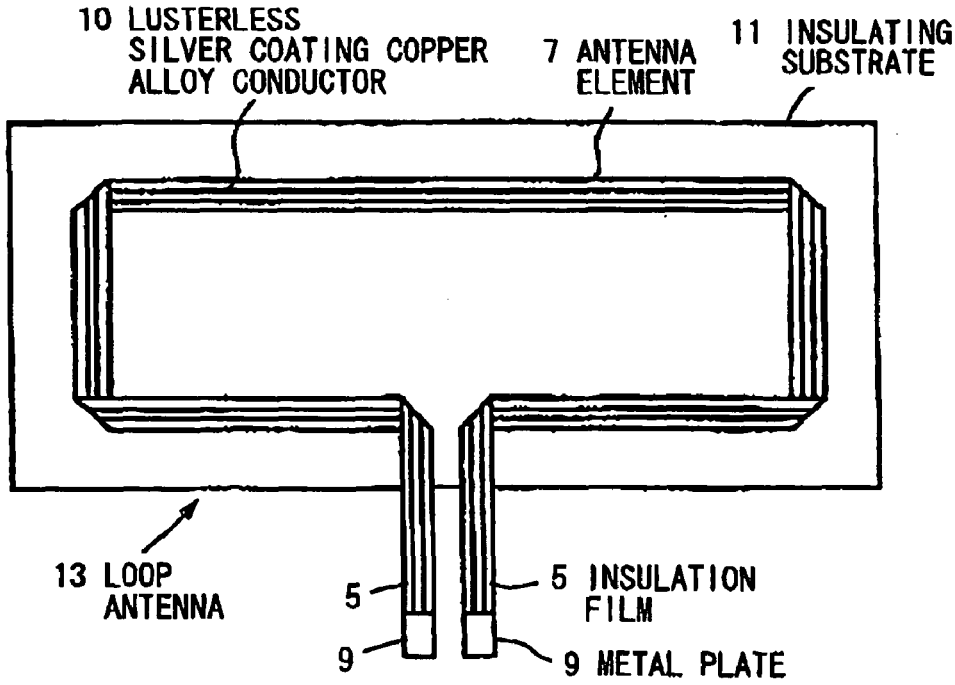
FIG. 6 is a schematic diagram showing a loop antenna in quadrangular shape formed using an antenna element of the invention.
Figure 7:
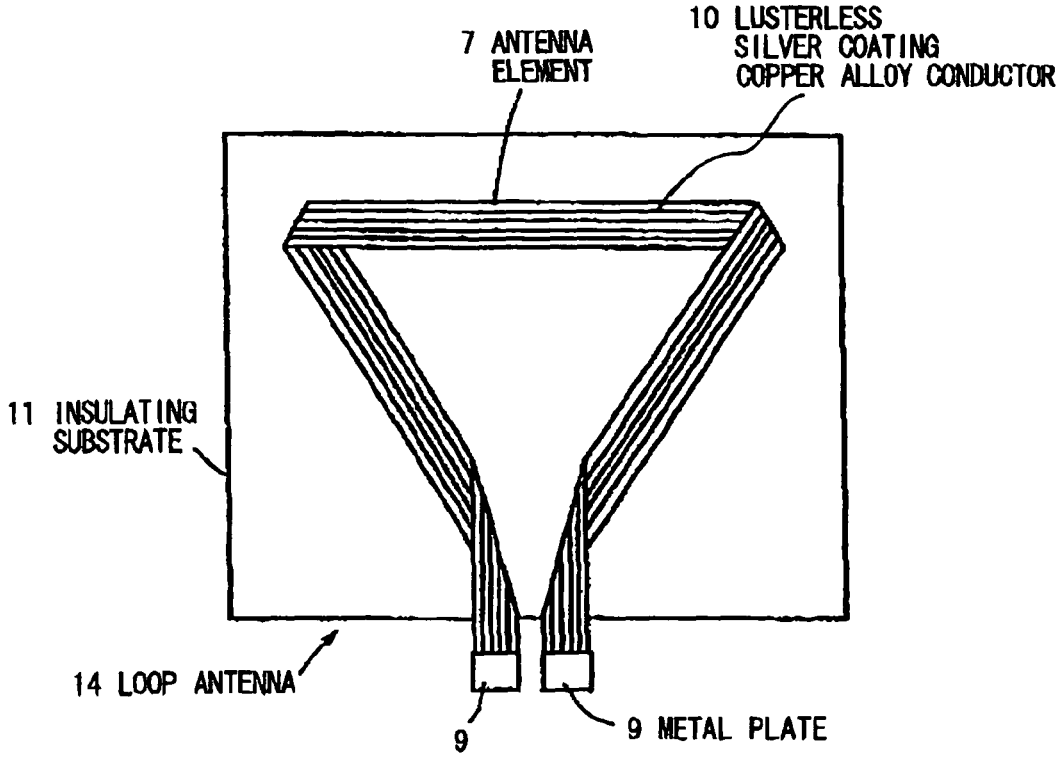
FIG. 7 is a schematic diagram showing a loop antenna in inverted triangle shape formed using an antenna element of the invention.
Figure 8:
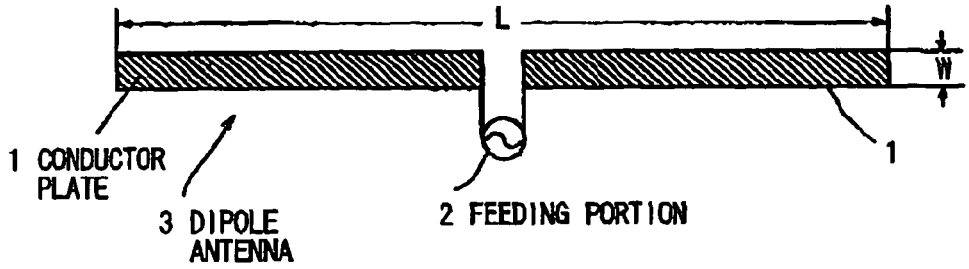
FIG. 8 Prior Art
FIG. 8 is a schematic diagram showing the conventional dipole antenna.

The manufactured antenna element 7 is cut into a suitable length such that it is adapted to an electric wave to be transmitted and received and an installation place. For instance, a dipole type antenna 12 is formed by being bent into L-shape and being opposed as shown in FIG. 5, or a loop antenna 13 is formed by being bent into quadrangular shape as shown in FIG. 6, or a loop antenna 14 is formed by being bent into inverted triangle shape as shown in FIG. 7.

To fix the shape, the antennas 12, 13 and 14 are further attached with the planar shape on an insulating substrate 11 of an insulating film with a sticking or the adhesion layer, or by being sandwiched by the two insulating substrates 11.

The feeding is enabled by attaching a metal wire or the metal plate 9, at the feeding portion of the antennas 12, 13 and 14, on the insulation film 5 of the antenna element 7 as shown in FIG. 1 such that the metal plate 9 is electrostatically coupled to the line conductor 4 of the antenna element 7 through the insulation film 5.

Thus, current is induced on each of the line conductors 4 of the antenna element 7, and received power is obtained through the metal plate 9.

Since the line conductors 4 have the same length, the received power from each line conductor 4 is synthesized at the same phase on the metal plate 9 as the feeding portion.

Although the line conductor 4 has a high resistance value due to its thinness, it becomes a parallel circuit for the above-mentioned reason. If the number N is sufficiently large, the resistance value of the antenna becomes one of N-th and the resistance loss can be decreased so that the impedance matching can be easy obtained.

For instance, in case of a dipole antenna of L=wavelength/2=300 mm for 500 MHz (i.e., a wavelength of 600 mm) using silver coating copper alloy wires with a resistance value of $1.5\times10^{-8}\Omega$ and a diameter of 0.02 mm, the high-frequency resistance of the dipole antenna 12 with a length of L as shown in FIG. 5 becomes about 150Ω for a single wire, and the heat loss increases as the resistance is far bigger than 73.13Ω, a radiation resistance value of the antenna. However, when the number N of the line conductor 4 is 50, the high-frequency resistance is reduced to about 3Ω and the heat loss becomes a negligible level.

At this time, provided that the interval of the line conductors 4 is 0.2 mm, i.e., ten times the diameter of the line conductor 4, the width accounted by a part where the line conductors 4 are wired becomes about 10 mm, which is equal to the width of general antennas.

Further, in a general visual acuity of naked eyes, since about ϕ0.04 mm is a limit of the vision at 2.0 in indicator of general eyesight (fractional visual acuity) when seeing the line conductor 4 at a distance of 250 mm. Thus, the visibility of the line conductor becomes difficult when the conductor diameter is ϕ0.04 mm or less, preferably ϕ0.02 mm or less.

Further, if the interval between the line conductors 4 is ten times or more the diameter of the line conductor, the area intercepted by the line conductor 4 becomes 10% or less and the influence to the transparency of the antenna is small enough to see the background of the antenna. It is preferred that the interval between the line conductors 4 is ten times or more the diameter of the line conductor 4.

To reduce the visibility, it is preferred that the surface of the line conductor 4 is light in color and lusterless by being formed of tin or silver coating copper alloys rather than copper or brass with deep color and luster.

The diameter of the line conductor 4 is not limited to 0.04 mm or less as mentioned above, and any diameters are acceptable as long as the visibility can be sufficiently reduced. The material of the line conductor 4 and the plating is not limited to that with the plating of tin and silver, anything is acceptable as long as the visibility can be sufficiently reduced and the feeding can be sufficiently obtained.

The number of the line conductors 4 can be 50 or more as long as the feeding can be sufficiently obtained. The interval between the line conductors 4 is not limited to equal interval, each interval can be varied. The insulation film 5, the sticking or adhesion layer 6 and the insulating substrate 11 are not particularly limited as long as the transparency can be secured.

The shape of the antenna is not limited to the shape shown in FIGS. 5 to 7, any shapes can be accepted which are capable of obtaining the radiation characteristics according to the purpose. In sum, according to the antenna of the invention, different shapes of antennas can be produced at low cost easily according to the customer's way of use or the customer's intended purpose.

More specifically, in the conventional method (i.e., paint method and etching method) for manufacturing the antenna, one mask plate is necessary for one variety and another mask plate is necessary for another variety. Therefore, the manufacturing cost has been increased that much.

In contrast, the antenna element 7 of the invention can be applied to even complex shapes such as an in-vehicle antenna, and also to many varieties (especially to small production type) since it can be a desired length wound off from the long antenna element wound to the wind-up reel and then bent into a desired shape.

Further, according to the antenna element 7 of the invention, the mask plate is not necessary and the printing process or the etching process is not necessary, it is possible to achieve the production speed and low cost.

Further, in the conventional method (i.e., drawing method) for manufacturing the antenna, it takes time for the drawing work since the wire rod is drawn one by one. In contrast, when using the antenna element 7 of the invention, it is not necessary to draw in the molding process of the antenna since it can be manufactured in large quantities beforehand and can be kept in the wind-up reel. Thus, the shortening of the molding process of the antenna can be achieved by winding off a desired length the long antenna element and bending a plurality of wire rod units all together into desired shape. Consequently, the manufacturing cost can be reduced.

Further, since the antenna element 7 of the invention is formed by sandwiching both sides of the line conductors 4 by the insulation films 5, there is no need to worry about the short circuiting etc. of the line conductors 4, and the shape antenna can be freely designed.

The thickness and kind of the insulation film 5 and the adhesion layer 6 are not particularly limited and they can be optioned freely. Temperature in the rolling adhesion is not limited to 150° C., and appropriate temperature is optioned according to the kind of the binding material.

The metal plate 9 attached on the feeding portion is formed not necessarily like a plate and it may be formed linear. Further, the material or thickness of the metal plate is not particularly limited.

The line conductor 4 can be applied as a transparent electromagnetic wave interception film with a difficulty in visibility by forming the line conductor 4 into lattice or mesh. Thus, the electromagnetic wave can be intercepted without diminishing the visibility by attaching the film on the windowpane of premises, the surface of a cathode-ray tube, or a cover to protect human face.

Example 1

As shown in FIG. 5, 50 lusterless silver coating copper alloy conductors 10 with a diameter of ϕ0.02 mm are in parallel arranged at equal intervals of 0.2 mm. Then, the antenna element 7 is formed by conducting the rolling adhesion that the conductors 10 are sandwiched by the transparent insulation films 5 (made of, e.g., polyethylene terephthalate or polycarbonate) with a thickness of 0.015 mm and with the adhesion layer 6 with a thickness of 0.01 mm by using the rolling heat rolls 8 at temperature of 150° C. in accordance with the method explained in FIGS. 3 and 4.

The antenna element is cut into two strips in equal length, being bent by 90 degrees in midway and forming the dipole antenna 12 to be 300 mm in length L. Then, the dipole antenna 12 is sandwiched by transparent insulating substrates 11 (made of, e.g., polyethylene terephthalate or polycarbonate) with a thickness of 0.015 mm and with an adhesion layer of 0.01 mm while placing a part to be the feeding portion outside the insulating substrate 11, and adhered by rolling at temperature of 150° C.

A copper plate (i.e., metal plate 9) with a thickness of 0.1 mm is attached on the insulation film 5 of the antenna element 7 at the feeding portion, so that it is electrostatically coupled to the conductor 10 to enable the feeding.

Example 2

As shown in FIG. 6, 50 lusterless silver coating copper alloy conductors 10 with a diameter of ϕ0.02 mm are in parallel arranged at equal intervals of 0.2 mm. Then, the antenna element 7 is formed by conducting the rolling adhesion that the conductors 10 are sandwiched by the transparent insulation films 5 (made of, e.g., polyethylene terephthalate or polycarbonate) with a thickness of 0.015 mm and with the adhesion layer 6 with a thickness of 0.01 mm by using the rolling heat rolls 8 at temperature of 150° C. in accordance with the method explained in FIGS. 3 and 4.

The antenna element is cut into a strip with an appropriate length, being bent by 90 degrees in midway to form the rectangular loop antenna 13 to be 300 mm in long side and 50 mm in short side. Then, the loop antenna 13 is sandwiched by transparent insulating substrates 11 (made of, e.g., polyethylene terephthalate or polycarbonate) with a thickness of 0.015 mm and with an adhesion layer of 0.01 mm while placing a part to be the seeding portion outside the insulating substrate 11, and adhered by rolling at temperature of 150° C.

A copper plate (i.e., metal plate 9) with a thickness of 0.1 mm is attached on the insulation film 5 of the antenna element 7 at the feeding portion, so that it is electrostatically coupled to the conductor 10 to enable the feeding.

Example 3

As shown in FIG. 7, 50 lusterless silver coating copper alloy conductors 10 with a diameter of ϕ0.02 mm are in parallel arranged at equal intervals of 0.2 mm. Then, the antenna element 7 is formed by conducting the rolling adhesion that the conductors 10 are sandwiched by the transparent insulation films 5 (made of, e.g., polyethylene terephthalate or polycarbonate) with a thickness of 0.015 mm and with the adhesion layer 6 with a thickness of 0.01 mm by using the rolling heat rolls 8 at temperature of 150° C. in accordance with the method explained in FIGS. 3 and 4.

The antenna element is cut into a strip with an appropriate length, being bent in midway to form the inverted-triangular loop antenna 14 to be 300 mm in one side. Then, the loop antenna 14 is sandwiched by transparent insulating substrates 11 (made of, e.g., polyethylene terephthalate or polycarbonate) with a thickness of 0.015 mm and with an adhesion layer of 0.01 mm while placing a part to be the feeding portion outside the insulating substrate 11, and adhered by rolling at temperature of 150° C.

A copper plate (i.e., metal plate 9) with a thickness of 0.1 mm is attached on the insulation film 5 of the antenna element 7 at the feeding portion, so that it is electrostatically coupled to the conductor 10 to enable the feeding.

The antennas 12, 13 and 14 in Examples 1 to 3 are capable of reducing the visibility and receiving the VHF band and UHF band well.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. An antenna, comprising:

an antenna element bent in a predetermined shape, wherein the antenna element comprises a plurality of line conductors that are arranged in parallel and are sandwiched by two insulation films, and wherein the antenna element is sandwiched by two insulating substrates while exposing both ends of the antenna element from the two insulating substrates.

2. The antenna according to claim 1, wherein the insulating substrates and the insulation films comprise a material with a light transmitting property.

3. The antenna according to claim 1, wherein the plurality of line conductors is arranged in parallel in a direction of an extension of the antenna element.

4. The antenna according to claim 1, wherein an entirety of one of the line conductors is spaced apart from adjacent line conductors to said one of the line conductors.

5. The antenna according to claim 1, wherein the antenna comprises a plurality of bends of the line conductors.

6. The antenna according to claim 1, wherein the antenna comprises a loop that comprises the antenna element.

7. An antenna, comprising:

an antenna element bent in a predetermined shape, wherein the antenna element comprises a plurality of line conductors that are arranged in parallel and are sandwiched by two insulation films; and a metal plate that is attached onto the insulation films and at both ends of the antenna element.

8. The antenna according to claim 7, wherein the plurality of line conductors is sandwiched along an entire length of light conductors by said two insulation films.

9. An antenna, comprising:

an antenna element bent in a predetermined shape, wherein the antenna element comprises a plurality of line conductors that are arranged in parallel and are sandwiched by two insulation films, and wherein the line conductors each comprises a silver coating copper alloy, and has a diameter of 0.04 mm or less.

10. An antenna, comprising:

an antenna element bent in a predetermined shape, wherein the antenna element comprises a plurality of line conductors that are arranged in parallel and are sandwiched by two insulation films, and wherein an interval between neighboring line conductors is 10 times or more a diameter of each of the line conductors.

11. A method of making an antenna, comprising:

arranging in parallel a plurality of line conductors, each of which having a width of 0.04 mm or less, at intervals of 10 times or more a width of each of the line conductors;

discharging continuously the plurality of line conductors such that a visibility of the line conductors is reduced; and sandwiching continuously the discharged line conductors by planar transparent insulation films with a sticking or adhesion layer to have an antenna element.

12. The method according to claim 11, further comprising:

cutting the antenna element into an arbitrary length; and forming the antenna by bending the cut antenna element once or more at an arbitrary angle so as to allow an arbitrary adjustment of an emission characteristic of the antenna.

13. The method according to claim 11, further comprising:

fixing the antenna element on a planar transparent insulating substrate with a sticking or adhesion layer, or fixing the antenna element by sandwiching the antenna element between two planar transparent insulating substrates with a sticking or adhesion layer.

14. The method according to claim 11, further comprising:

attaching a metal line or a metal plate onto the insulation films at a feeding portion of the antenna element such that the metal line or the metal plate is electrostatically coupled to the line conductor through the insulation films to allow power feeding therebetween.

15. An antenna, comprising:

an antenna element bent in a predetermined shape, wherein the antenna element comprises a plurality of line conductors that are arranged in parallel and are sandwiched by two insulation films, and wherein both ends of each of the line conductors is exposed from the insulating films.

16. An antenna, comprising:

an antenna element bent in a predetermined shape, wherein the antenna element comprises a plurality of line conductors that are arranged in parallel and are sandwiched by two insulation films, and wherein two insulating substrates sandwich the antenna element.

17. The antenna according to claim 16, wherein the antenna comprises a plurality of bends of the line conductors to form a loop such that ends of the loop protrude from a same side of the insulating substrates.

* * * * *